US005704425A

United States Patent [19]

Divis et al.

[11] Patent Number: 5,704,425

[45] Date of Patent: Jan. 6, 1998

[54] MEASUREMENT PORT COUPLER AND PROBE INTERFACE

[75] Inventors: Jan J. Divis, North Vancouver; Franklin D. Patton, West Vancouver, both of Canada

[73] Assignee: Westbay Instruments, Inc., North Vancouver, Canada

[21] Appl. No.: 573,023

[22] Filed: Dec. 15, 1995

[51] Int. Cl.[6] ..... E21B 49/00

[52] U.S. Cl. ..... 166/191; 73/151

[58] Field of Search ..... 166/264, 100, 166/164, 191; 73/151

[56] References Cited

U.S. PATENT DOCUMENTS

| | | |
|---|---|---|
| 3,422,896 | 1/1969 | Nutter . |
| 3,860,069 | 1/1975 | Wray et al. . |
| 4,192,181 | 3/1980 | Patton et al. . |
| 4,204,426 | 5/1980 | Patton et al. . |
| 4,230,180 | 10/1980 | Patton et al. . |
| 4,254,832 | 3/1981 | Patton et al. . |
| 4,258,788 | 3/1981 | Patton et al. . |
| 4,580,632 | 4/1986 | Reardon . |
| 5,241,869 | 9/1993 | Czernichow . |

FOREIGN PATENT DOCUMENTS 2 036 137 6/1980 United Kingdom .

*Primary Examiner*—William P. Neuder
*Attorney, Agent, or Firm*—Christensen, O'Connor, Johnson and Kindness PLLC

[57] ABSTRACT

A measurement port coupler (26) having an improved measurement port (70) to allow fluid from the exterior of the measurement port coupler to be sampled by a probe (124) located on the interior of the measurement port coupler. A valve (72) in the measurement port is recessed in a conical depression (76) set in a wall of the measurement port coupler. The conical depression protects the valve from inadvertent opening and from wear. An improved probe interface (148) is provided to mate with the measurement port. The probe interface includes a face seal gasket (150) that contacts the conical depression of the measurement port prior to the measurement port being opened. A removable cover plate (88) is provided on the exterior of the measurement port coupler to filter any fluids that pass through the measurement port. A removable helical insert (110) is also provided for insertion into the measurement port coupler to aid in orienting the probe when samples or measurements are to be taken.

32 Claims, 6 Drawing Sheets

MEASUREMENT PORT COUPLER AND PROBE INTERFACE

FIELD OF THE INVENTION

The invention relates generally to couplers for below-ground casing assemblies, and in particular to couplers having a measurement port to allow sampling through the casing assembly.

BACKGROUND OF THE INVENTION

Land managers wishing to monitor the groundwater on their property have recognized the advantages of being able to divide a single borehole into a number of zones to allow monitoring of groundwater in each of those zones. If each zone is sealed from an adjacent zone, an accurate picture of the groundwater can be obtained at many levels without having to drill a number of boreholes that each have a different depth. A groundwater monitoring system capable of dividing a single borehole into a number of zones is disclosed in U.S. Pat. No. 4,204,426 (hereinafter the '426 patent). The monitoring system disclosed in the '426 patent is constructed of a plurality of casings that may be connected together in a casing assembly and inserted into a well or borehole. Some of the casings may be surrounded by a packer element made of a suitably elastic or stretchable material. The packer element may be inflated with fluid, gas, or other material to fill the annular void between the casing and the inner surface of the borehole. In this manner, a borehole can be selectively divided into a number of different zones by appropriate placement of the packers at different locations in the casing assembly. Inflating each packer isolates zones in the borehole between adjacent packers.

The casings in a casing assembly may be connected with a variety of different types of couplers. One type of coupler that allows measurement of the quality of the fluid or gas in a particular zone is a coupler containing a valved measurement port (hereinafter the measurement port coupler). The valve can be opened from the inside of the coupler, allowing fluid or gas to be sampled from the zone surrounding the casing.

To perform the sampling, a special measuring instrument or sample-taking probe is provided that can be moved up and down within the interior of the casing assembly. The probe may be lowered within the casing assembly on a cable to a known point near a measurement port coupler. As disclosed in the '426 patent, when the probe nears the location of the measurement port coupler, a location arm contained within the probe is extended. The location arm is caught by a helical shoulder that extends around the interior of the measurement port coupler. The location arm slides down the helical shoulder, rotating the sample-taking probe as the probe is lowered. At the bottom of the helical shoulder, the location arm reaches a stop that halts the downward movement and circumferential rotation of the probe. When the location arm stops the probe, the probe is in an orientation such that a port on the probe is directly adjacent and aligned with the measurement port contained in the measurement port coupler.

When the probe is adjacent the measurement port, a shoe is extended from the sample-taking probe to push the probe in a lateral direction within the casing. As the shoe is fully extended, the port in the probe is brought into contact with the measurement port in the measurement port coupler. At the same time the probe is being pushed against the measurement port, the valve within the measurement port is being opened. The probe may therefore sample the gas or fluid contained in the zone located outside of the measurement port coupler. Depending upon the particular instruments contained within the probe, the probe may measure different characteristics of the exterior fluid or gas in the zone being monitored such as the pressure, temperature, or chemical composition. Alternatively, the probe may also allow samples of gases or fluids from the zone immediately outside the casing to be stored and returned to the surface for analysis.

After the sampling is complete, the location arm and the shoe lever of the probe may be withdrawn, and the probe retrieved from the casing assembly. It will be appreciated that the probe may be raised and lowered to a variety of different zones within the casing assembly, in order to take samples at each of the zones. A land manager may select the type of probe and the number and location of the zones within a borehole to configure a groundwater monitoring system for a particular application. The expandability and flexibility of the disclosed groundwater monitoring system therefore offers a tremendous advantage over prior art methods requiring the drilling of multiple sampling wells.

While the measurement port coupler shown in the '426 patent allows multi-level sampling and monitoring within a borehole, long-term use of the couplers has suggested several shortcomings in their design. In particular, the design of the valve in the measurement port causes the valve to protrude into the interior of the measurement port coupler. By protruding into the coupler, there is the chance that the valve may be inadvertently bumped as a probe is raised and lowered within the casing assembly. Inadvertently bumping the valve could cause the measurement port to open when the probe is not in a desired position to sample from the measurement port.

The protrusion of the measurement port valve also effects the quality of the pressure measurements that may be obtained using the design of the '426 patent. Because the valve extends beyond the surface of the coupler, the valve of the measurement port begins to open before the probe is completely sealed against the interior wall of the coupler. For a brief instant, the premature opening of the valve allows fluids or gas from the exterior of the coupler to be released to the interior of the coupler. Although in certain circumstances the amount of pressure release caused by the premature valve opening may be minimal, in order to obtain accurate pressure measurements it would be advantageous to have the valve of the measurement port open after the probe is fully sealed against the measurement port.

Another shortcoming of the coupler design in the '426 patent is that during long-term use the interior of the measurement port coupler has a tendency to wear as probes are raised and lowered within the casing assembly. The wearing may take the form of scratches, pitting, or other surface marring that occurs as dirt or grit is compressed between the probe and the interior of the coupler. It has been found that over extended periods of time, the occurrence of scratches or pitting on the interior surface of the coupler near the valve of the measurement port reduces the quality of the seal that can be achieved between the sampling probe and the measurement port.

A still further shortcoming of the coupler in the '426 patent is that the coupler is difficult to manufacture. In the '426 patent coupler, the helical shoulder is integrally constructed with the measurement port coupler. In applications in which the casing is formed in metal, such as steel, the shoulder cannot be easily machined although it can be casted. Cast steel products, however, typically do not have the desirable properties of rolled steel products. More recently, plastic or stainless steel have become the desired material for constructing a multi-level sampling system in order to minimize corrosion and other contamination problems that prior art systems generate. When attempting to form the coupler in plastic or rolled metals, however, the variable thickness of the coupler caused by the helical shoulder greatly complicates the forming and manufacturing process. In particular, with molded plastics an integral helical shoulder has a tendency to cause uneven cooling in the measurement port coupler, causing the coupler to buckle and warp. And when machining the interior of a metal cylinder, producing a helical shoulder is an exceptionally difficult task.

Yet another disadvantage of the measurement port design described in the '426 patent is that the measurement port is covered with a permanent and non-removable cover. It is therefore impossible to repair or otherwise replace a damaged component in the measurement port during the manufacturing process, or after use in the field.

The present improvements to the measurement port coupler seek to overcome the above-described and other shortcomings of the measurement port couplers of the type described in the '426 patent.

SUMMARY OF THE INVENTION

In accordance with this invention, an improved measurement port coupler and an improved probe interface to allow fluid from the exterior of the measurement port coupler to be sampled by a probe located on the interior of the measurement port coupler is provided. The measurement port coupler includes a measurement port.

In accordance with one aspect of this invention, a measurement port valve is recessed in a conical depression so that the end of the valve does not extend beyond the interior wall of the coupler. Because the valve is recessed, sampling probes raised and lowered within the measurement port coupler cannot inadvertently contact the valve. The valve is therefore not subject to wear or inadvertent opening. The conical depression surrounding the valve further provides an improved sealing surface when the probe is brought into contact with the measurement port. Because the conical depression is recessed from the interior of the measurement port coupler, scratching or pitting is minimized from probes that are raised or lowered within the casing assembly. An improved seal may therefore be made between the sampling probe and the measurement port over the life of the coupler.

In accordance with another aspect of this invention, the probe contains an interface having a face seal gasket for sealing the probe with the conical depression of the measurement port. The face seal gasket is brought into contact with the conical depression as the probe is pushed into sampling position by the extension of a shoe lever. A seal is made between the probe and the measurement port prior to the valve of the measurement port being opened. As a result, pressure measurements are improved since no pressure is released prior to opening the valve to the exterior of the coupler.

In accordance with still another aspect of this invention, a removable cover plate or screen is provided on the exterior of the casing over the measurement port. The removable cover plate is advantageous in that it allows components within the measurement port to be removed and replaced if they are damaged during manufacture or use in the field. Further, the removable cover plate allows a user to select an appropriate screen size for a particular application. The filtering provided by the cover plate ensures that dirt or extraneous foreign matter contained outside the casing assembly is not inadvertently carried through the measurement port to the sampling probe during sampling operations.

In accordance with a further aspect of this invention, a helical shoulder within the interior of the measurement port coupler is formed as a removable insert. Forming the helical shoulder as a removable insert greatly improves the ability to manufacture the coupler in plastic or other materials having a cooling rate that is dependent on the thickness of the material. In rolled metal couplers, machining the helical shoulder as a separate insert allows the entire coupler to be precisely and simply constructed of a desired material. Moreover, with a separate helical insert it is also possible to mix the material used for each coupler component, for example, by inserting a steel helical insert in a plastic coupler.

An improved measurement port coupler formed in accordance with this invention has several advantages. Overall, it will be appreciated from the foregoing summary that a measurement port and a measurement port coupler formed in accordance with this invention have both improved the quality and longevity of the connection between the probe and the measurement port coupler. In particular, the improved measurement port and probe interface increases the accuracy of pressure measurements taken by sampling probes. Limiting the amount of pressure release that occurs as the probe is brought into contact with the measurement port ensures that the pressure being measured closely reflects the pressure of the gas or liquid on the exterior of the measurement port coupler. The conical depression in the measuring port coupler also results in a significant simplification in the geometry of the face seal on the probe. Instead of the complex face seal geometry dictated by having to mate two cylindrical surfaces as disclosed in the '426 patent, the conical depression allows the axes of the face seal and the conical depression to coincide. The simplified geometry of the present invention therefore provides a higher pressure seal than the face seal disclosed in the '426 patent.

An additional advantage of the measurement port coupler is that the recessed measurement port provides greater reliability for a measurement port coupler installed in a groundwater monitoring system for extended periods of time. The reduced wear on the valve and the coupler surface surrounding the valve ensures that an improved seal may be made between the probe and the coupler for the life of the coupler. Finally, the improved measurement port coupler is easier to manufacture due to the inclusion of a helical insert and a replaceable cover plate on the exterior of the measurement port. The improved measurement port coupler therefore offers significantly improved performance over the coupler disclosed in the '426 patent.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
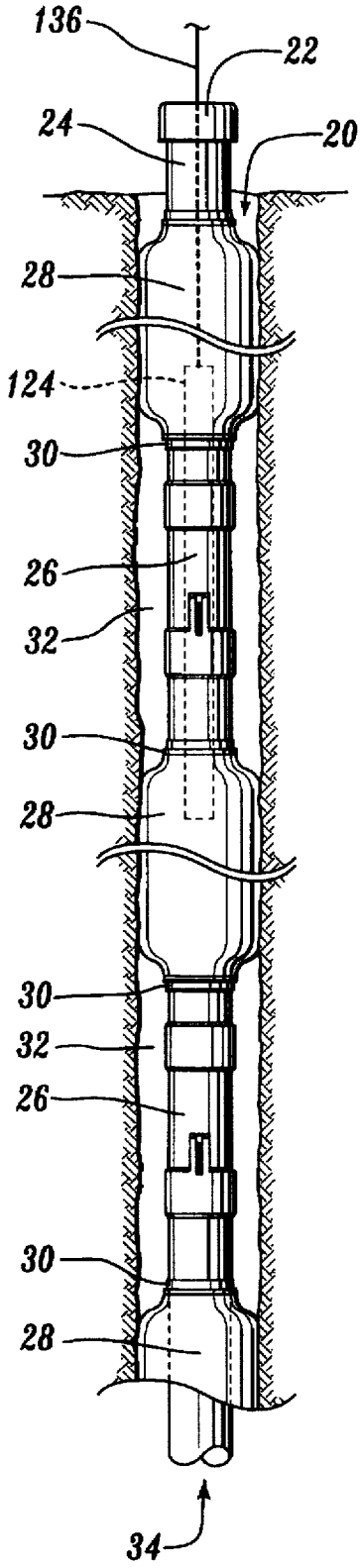
FIG. 1 is a diagram of a borehole in which geological casings are connected by measurement port couplers of the present invention to form a casing assembly.

A cross-section of a typical well or borehole 20 in which a measurement port coupler formed in accordance with this invention may be used is shown in FIG. 1. Lowered into well or borehole 20 is a casing assembly 22. The casing assembly is constructed of a plurality of elongate casings 24 that are connected by measurement port couplers 26 of the present invention. Selected casings within the casing assembly may be constructed with a packer element 28 surrounding the casing. The packer elements are formed of a membrane or bag that is elastic or stretchable, such as natural rubber, synthetic rubber, or a plastic such as urethane. Urethane is preferred because it is readily moldable, and has high strength and abrasion characteristics. The packer element is clamped on opposite ends of elongate casing 24 by circular fasteners or clamps 30. The ends of each casing project beyond the ends of the packer element 28 to allow the casings to be joined together to form the casing assembly.

Using a method that is beyond the scope of this invention, the packer elements 28 are expanded to fill the annular space between the casing assembly 22 and the interior walls of the borehole 20. The expansion of the packer elements divides the borehole into a plurality of zones 32 that are isolated from each other. The number of zones that the borehole is divided into is determined by a user, who may selectively add elongate casings, packers, and couplers to configure a groundwater monitoring system for a given application.

The interior of the casings forms a continuous passageway 34 that extends the length of the casing assembly 22. A probe or other sampling tool 124 may be lowered from the surface on a cable 136 to a desired level within the casing assembly. As will be described in further detail below, the measurement port couplers 26 each contain a valved measurement port that allows fluid or gas contained within each zone of the borehole to be sampled from inside of the casing assembly. The probe is lowered until it is adjacent a desired measurement port coupler, at which time the measurement port valve is opened to allow the probe to measure pressure or to sample a characteristic of the gas or liquid within that zone. Further details about the general operation of the multi-level groundwater monitoring system may be found in U.S. Pat. Nos. 4,192,181, 4,204,426, 4,230,180, 4,254,832, and 4,258,788, all assigned to Westbay Instruments, Ltd., and incorporated herein expressly by reference.

Figure 2:
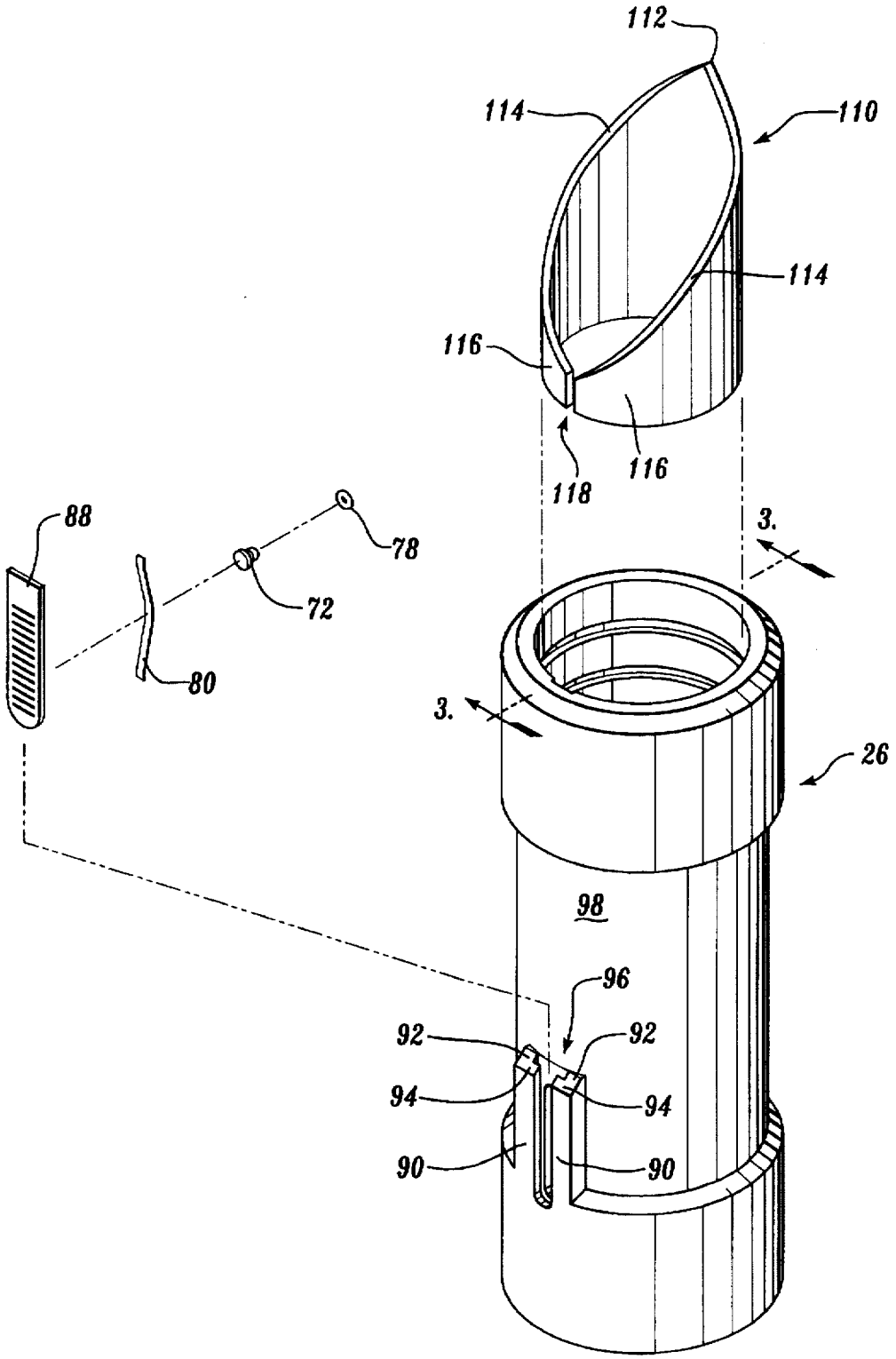
FIG. 2 is a side elevation of a measurement port coupler of the present invention having a removable cover plate and helical insert.
Figure 3:
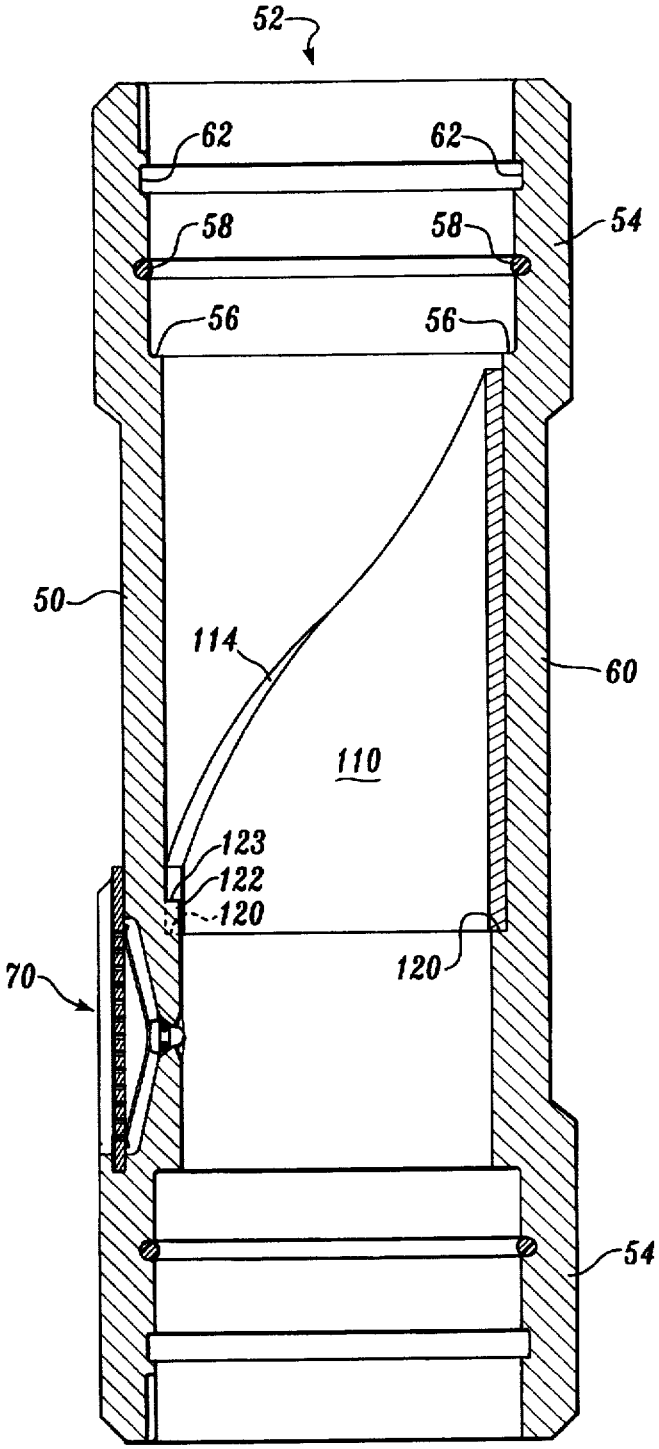
FIG. 3 is a longitudinal section of the measurement port coupler taken along line 3—3 of FIG. 2.
Figure 4:
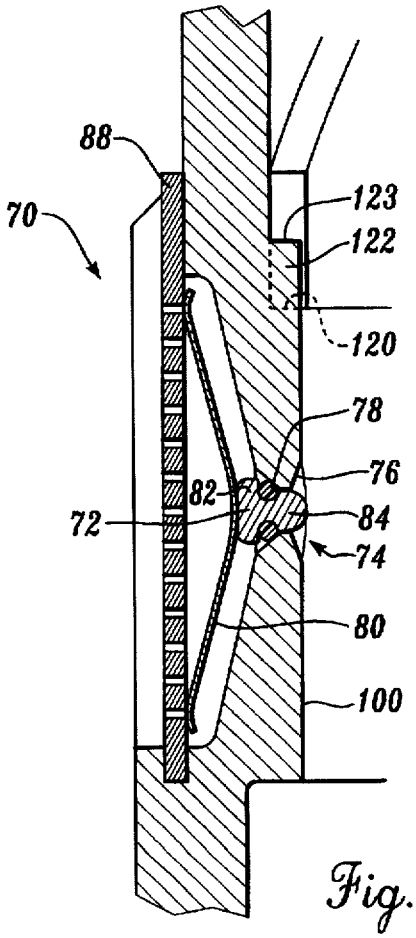
FIG. 4 is an expanded cross section of a measurement port contained in the measurement port coupler of the present invention.

A preferred embodiment of the measurement port coupler 26 of the present invention is illustrated in FIGS. 2–4. As shown in FIGS. 2 and 3, the coupler is generally tubular in shape with an external wall 50 surrounding and forming an inner passageway 52. The ends of the coupler are open, and have thicker end portions 54 to receive the ends of elongate casings 24. Casings 24 are inserted into the ends of the coupler until they come into contact with stop 56 formed by a narrowing of passageway 52 to a smaller diameter. Suitable means for mating each of the couplers to the elongate casings are provided. Preferably, an O-ring gasket 58 is contained in the end portion 54 of each coupler to provide a water-tight seal between the exterior wall of the elongate casing and the interior wall of the measurement port coupler. A flexible lock ring or wire (not shown) is also provided in a groove 62 to lock the elongate casing onto the measurement port coupler.

When assembled, the elongate casings and measurement port couplers will be aligned along a common axis. The interior or bore of the elongate casings 24 have approximately the same diameter as the interior or bore of the couplers. A continuous passageway is therefore created the length of the casing assembly 22.

A middle portion 60 of the measurement port coupler contains a measurement port 70, shown in cross-section in FIG. 4. The measurement port comprises a valve 72 that is seated within a bore 74 that passes through the wall of the measurement port coupler. Valve 72 is shaped like a cork bottle stopper, with a larger rear portion 82 facing the exterior of the measurement port coupler and a smaller and rounded stem 84 facing the interior of the measurement port coupler. An O-ring gasket 78 around a middle portion of the valve seals the valve 72 within bore 74. The O-ring gasket provides an airtight seal around the valve to ensure that fluids or other gases are not allowed into the passageway 52 from the exterior of the measurement port coupler when the valve is closed.

The valve 72 is normally biased closed by a spring 80 that presses against the rear portion 82 of the valve. The rear portion 82 of the valve is wider than the diameter of bore 74 to prevent the valve from being pushed into the interior of the measurement port coupler. Preferably, spring 80 is a flat spring that is held in place by a cover plate 88. It will be appreciated, however, that other types of springs may be used to bias valve 72 in a closed position.

Cover plate 88 is constructed of a wire mesh or other type of filter material that fits over the exterior of the measurement port 70. As shown in FIG. 2, an exterior surface 98 of the measurement port coupler is constructed with two parallel retaining arms 90 that surround the measurement port. Each retaining arm has a base 92 and an upper lip 94 that cooperate to form a slot 96 shaped to receive the cover plate. The cover plate is slid within slot 96 so that it is maintained in place by friction between the upper lip 94 of each retaining arm, the cover plate 88, and the exterior surface 98 of the measurement port coupler. When affixed in place, the cover plate covers the entire measurement port including the valve 72. Any fluid or gas that passes from the exterior of the measurement port coupler through the measurement port must therefore first pass through cover plate 88. While slots are shown in cover plate 88, it will be appreciated that holes or other apertures of different sizes and shapes may be selected depending on the necessary filtering in a particular application.

It will be appreciated that alternate methods may be used to secure the cover plate to the exterior surface 98 of the measurement port coupler. For example, the cover plate may be held in place by screws that pass through the cover plate and into the body of the measurement port coupler. Alternately, clips or other fasteners may be fashioned to secure the edges of the cover plate. Any means for securing the cover plate to the measurement port coupler must securely hold the cover plate, yet allow removal of the cover plate for access to the measurement port.

The cover plate 88 serves at least three purposes in the measurement port coupler. First, the cover plate maintains the position of the flat spring 80 so that the spring biases the valve 72 in a closed position. Second, the cover plate filters gases or fluids that pass through the measurement port. The cover plate ensures that large particles do not inadvertently pass through the measurement port, potentially damaging or locking the valve of the measurement port in an open or closed position. Because the cover plate is removable and interchangeable, a user may select a desired screen or filter size that is suitable for the particular environment in which the multi-level sampling system is used. Finally, the cover plate allows access to the valve and the measurement port. During manufacturing or after use in the field, the valve must be tested to ensure that it correctly operates in the open and closed position. If the valve were to be defective, for example by allowing water or gas to pass through the port while in the closed position, then the cover plate may be removed to allow repair of the valve and other components in the measurement port. In this manner, it is a simple matter to remove and replace valve 72, O-ring gasket 78, or spring 80 if they are damaged during the manufacturing process or if they need to be replaced in a system that is to be reused.

Returning to FIG. 4, the valve 72 is seated in the wall of the measurement port coupler at the apex of a conical depression 76. The conical depression tapers inward from an interior surface 100 of the measurement port coupler to the start of the bore 74. The stem 84 of valve 72 is sized so that the stem of the valve does not protrude beyond the interior surface 100 of the measurement port coupler. The valve therefore sits within the conical depression at or below the level of the interior surface.

The conical depression serves several functions. First, the conical depression recesses the valve below the level of the interior surface so that a probe passing through the passageway 52 of the measurement port coupler does not inadvertently open the valve. In addition to preventing inadvertent opening, the valve is also protected from abrasion or other damage as a probe is raised and lowered through the passageway. Moreover, the conical indentation also provides a protected sealing surface that the probe or other measurement tool may seal against when sampling fluids through the measurement port 70. Because the conical indentation is recessed from the interior surface of the measurement port coupler, the indentation is protected from abrasions or other scarring that may occur as probes pass through the passageway. The surface of the conical indentation therefore remains relatively smooth, ensuring that a precise and tight seal may be made with the surface when sampling is being performed through the measurement port.

With respect to FIGS. 2 and 3, the middle portion 60 of the measurement port coupler is constructed to allow insertion of a helical insert 110. The helical insert is nearly cylindrical, with two symmetric halves that taper downwardly from an upper point 112 in a helical shoulder 114 before terminating at outer ends 116. A slot 118 separates the two halves of the insert between the outer ends 116.

The helical insert 110 may be fitted within the middle portion 60 by insertion into passageway 52 until the insert hits stop 120 formed by a narrowing of passageway 52 to a smaller diameter. A locating tab 122 protrudes from the interior surface of the measurement port coupler to ensure proper orientation of the helical insert in the measurement port coupler. When properly inserted, locating tab 122 fits within slot 118 so that each helical shoulder 114 slopes downward toward the measurement port. As will be described in further detail below, the locating tab is used to correctly orient a probe with respect to the measurement port and to expand the diameter of the insert to provide an interference fit. The helical insert is fixed in place in the coupler by manufacturing the insert to have a slightly larger diameter than the coupler. By flexing the halves of the insert toward each other as the insert is placed in the coupler, the rebound tendency of the insert secures the insert against the coupler walls. The helical insert is further prevented from travel in the coupler by stop 120, which prevents downward motion, locating tab 122, which prevents rotational motion, and a casing (not shown) fixed in the upper end 54, which prevents upward motion.

Forming the helical insert as a separate piece greatly improves the manufacturability of the measurement port coupler. The measurement port coupler may be made out of a variety of different materials, including metals and plastics. Preferably, multi-level monitoring systems are constructed of polyvinyl chloride (PVC), stable plastics, stainless steel, or other corrosion resistant metals so that contamination will not be introduced when the system is placed in a borehole. When plastic is used, it is very difficult to construct a PVC measurement port coupler having an integral helical insert without warping. Manufacturing the helical insert separately, and then inserting the insert into the interior of the measurement port coupler, allows the coupler to be constructed entirely of PVC. Securing the helical insert in place without the use of glue further minimizes the contamination that is introduced into the borehole.

Figure 5:
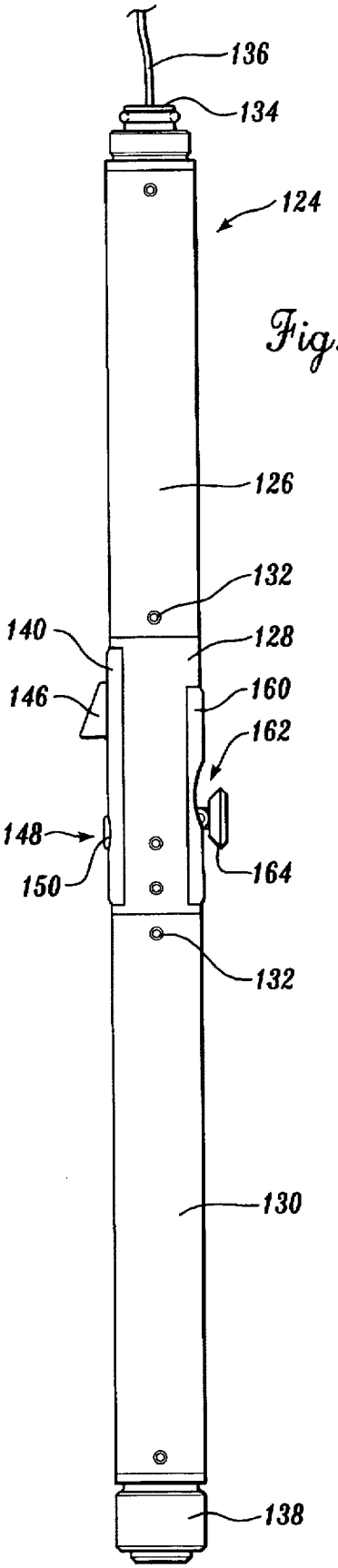
FIG. 5 is a diagrammatic elevation of an instrument or probe for taking samples through the measurement port coupler.
Figure 6:
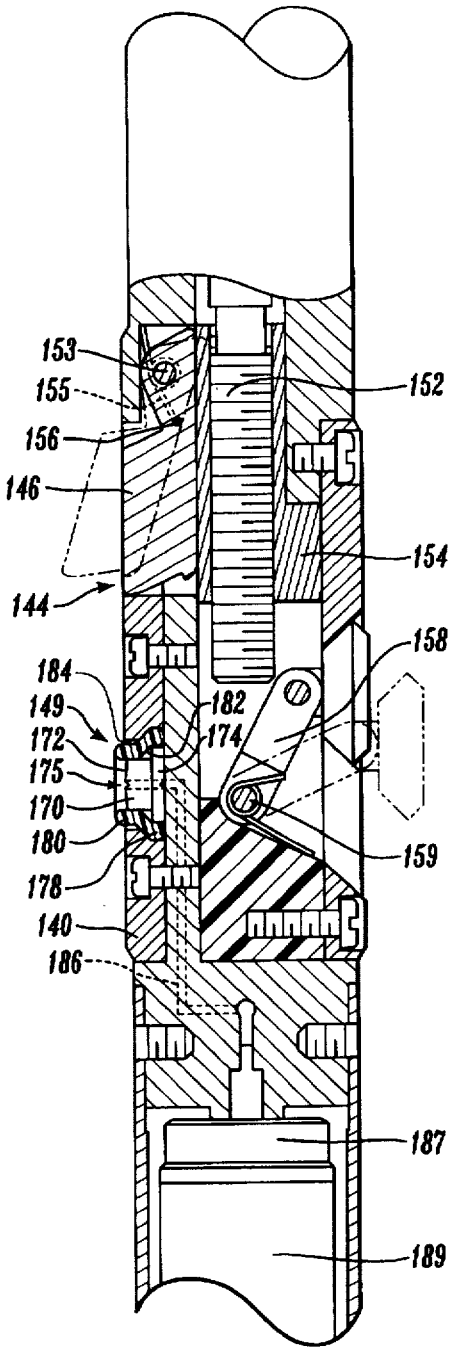
FIG. 6 is a longitudinal section of the probe showing an interface for mating with the measurement port in the measurement port coupler.

The measurement port is provided to enable samples of liquids or gases to be taken from the borehole zone 32 outside of the measurement port coupler. FIGS. 5 and 6 illustrate an exemplary probe 124 that may be lowered within casing assembly 22 to sample gases and fluids in the borehole and to measure the fluid pressure. The probe is generally in the form of an elongate cylinder having an upper casing 126, a middle casing 128, and a lower casing 130. The three casing sections are connected together by housing tube mounting screws 132 to form a single unit. Attached at the top of the probe is a coupler 134 that allows the probe to be connected to a cable 136. Cable 136 is used to raise and lower the probe within the casing assembly. Cable 136 also carries power and other electrical signals to allow information to be transmitted and received between a computer (not shown), located outside of the borehole, and the probe suspended in the borehole. An end cap 138 is disposed on the lower casing of the probe to allow additional components to be attached to the probe to configure the probe for a particular application.

The middle casing 128 of the probe contains an interface 148 to allow the probe to mate with the measurement port coupler. Laterally disposed on the side of middle casing 128 is a face plate 140. Face plate 140 is semi-cylindrical in shape to match the inside surface 100 of the measurement port coupler, and is slightly raised with respect to the outside surface of the cylindrical middle casing 128. The face plate 140 is constructed with a slot 144 to allow a location arm 146 to extend from the probe. In FIG. 5, the location arm 146 is shown in an extended position where it protrudes from the middle casing of the probe. The location arm is normally in a retracted position, as shown in FIG. 6, in which it is nearly flush with the surface of the probe. In the normally retracted position, the probe may be raised and lowered within the casing assembly 22.

When it is desired to stop the probe at one of the measurement port couplers in order to take a measurement, the probe is lowered or raised to a position slightly above the known position of the measurement port coupler. The locating arm is then extended, and the probe slowly lowered so that the probe is passed through the measurement port coupler. In the extended position, location arm 146 will come into contact with one of the helical shoulders 114 of the helical insert within the measurement port coupler. As the probe is lowered further, the location arm travels downward along the helical shoulder until the arm is caught within notch 118 at the bottom of the shoulder. The downward motion of the location arm 146 on the helical shoulder rotates the body of the probe to bring the probe into a desired alignment. When the locating arm enters notch 118 at the bottom of the helical insert, the probe is brought to a halt with the locating arm resting on the upper surface 123 of the locating tab 122. When the location arm is located on the locating tab, the probe is correctly oriented in the measurement port coupler to bring the probe interface 148 directly adjacent to the measurement port 70.

Interface 148 allows fluid or gas to be taken inside the probe for measurement and/or sampling purposes. As shown in the cross section of FIG. 6, an aperture 149 is provided in the face plate 140 of the interface 148. The interface includes a plunger 170 and an elastomeric face seal gasket 150. The plunger 170 is generally cylindrical in shape, with an outer surface 172 that is conical to correspond to the conical depression in the wall of the coupler, and a base portion 174 having a larger diameter than the plunger body. A bore 175 is formed in the plunger that extends through the plunger to the interior of the probe. The bore allows fluid or other gases to enter the probe along a path generally designated in FIG. 6 by a dotted line 186. The fluid is channeled to a pressure transducer 187 or other instrumentation or container to perform the desired measurement or sampling of the fluid. An electronic data module 189 is provided in the probe to transmit the results of the measurements to a computer on the surface.

The face seal gasket 150 is formed to surround the plunger and protrude beyond the outer surface of the face plate 140. Face seal gasket 150 has an outer portion 180 with a smaller diameter to surround the outer portion of the plunger, and an inner portion 178 having a larger diameter to surround the base portion 174 of the plunger. Outer portion 180 has a rounded surface that is optimized for contact with the conical depression. It will be appreciated that the conical indention simplifies the geometry of the sealing gasket required on the probe to mate with the measurement port. Rather than having to mate with a cylindrical surface, which required a gasket that curved along two axes, the sealing gasket must only be formed to mate with a conical surface along a single axis. The simplified gasket design therefore provides a higher pressure seal than the complex geometries used in the prior art.

The face seal gasket 150 is formed so that two expansion voids 182 and 184 exist around the face seal gasket. A first expansion void 182 is left between the face seal gasket and the plunger, and a second expansion void 184 is left between the face seal gasket and the face plate. As will be described in greater detail below, these expansion voids allow the face seal gasket to be fully compressed as the probe is brought in contact with the measurement port to minimize an increase in pressure due to the probe's movement. Preferably, the face seal gasket is constructed of natural or synthetic rubber or other compressible material to allow a tight seal to be made between the probe and the measurement port coupler.

To bring the interface 148 into contact with the measurement port 70 in the measurement port coupler, the probe must be moved laterally within the measurement port coupler. On the side of the middle casing 128 opposite the face plate is a shoe plate 160 that protrudes slightly from the outer cylindrical surface of middle portion 128. Shoe plate 160 is formed with an aperture 162 to allow a shoe 164 to be extended beyond the surface of the probe. In the extended position, the shoe is brought into contact with the inner surface 100 of the measurement port coupler, forcing the probe laterally within the interior of the coupler, and bringing the probe interface 148 into contact with the conical surface 76 of the measurement port 70.

The mechanism for extending the location arm 146 and shoe 164 is shown in FIG. 6. A motor in the upper probe casing turns an actuator screw 152 in the middle casing. When turned in a forward direction, the actuator screw causes a threaded actuator nut 154 to travel along the actuator screw towards a shoe lever 158. The initial turns of the actuator screw move the actuator nut a sufficient distance downward in the probe body to allow the location arm 146 to pivot around pivot pin 153. A coil spring 155 is wound around the pivot pin and attached to hole 156 in the location arm to bias the location arm in the extended position. Additional turns of the actuator screw move the actuator nut further downward in the probe body until the screw contacts a shoe lever 158. As the actuator nut continues to advance, the shoe lever pivots around pivot pin 159, forcing the shoe 164 to swing outward from the probe body. When the actuator nut reaches a fully advanced position, the shoe will be extended as shown in phantom in FIG. 6. The retraction of the actuator nut reverses the extension process. When the actuator screw is turned in a reverse direction, the actuator nut is moved upward in the probe body. As the actuator nut moves upward, the shoe is retracted by a spring attached to the shoe lever. Continued motion of the actuator nut brings the actuator nut into contact with the location arm, pivoting the arm to a retracted position.

Figure 7A:
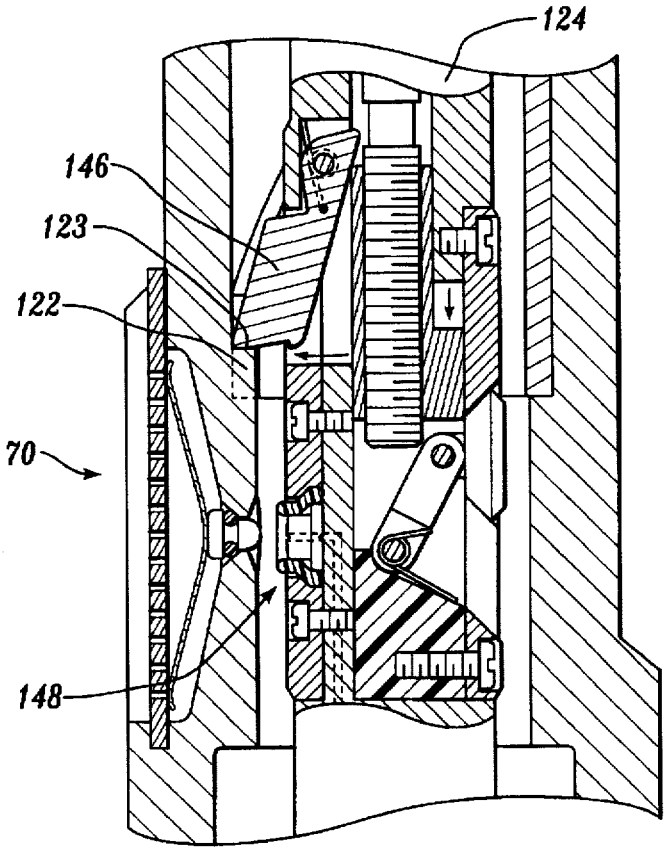
FIGS.7A–7D are expanded cross-sections of the probe and the measurement port showing the sequence of events as the probe is pushed into contact with the measurement port to allow pressure measurements to be made or samples to be taken.

The sampling or pressure measurement process may be better understood by the sequence shown in FIGS. 7A through 7D. As shown in FIG. 7A, a probe 124 has been lowered into a position near measurement port 70. Location arm 146 has been extended and the probe lowered to bring the location arm into contact with the upper surface 123 of the locating tab 122, stopping the probe at the desired position in the measurement port coupler. In the stopped position, the measurement port 70 on the measurement port coupler is adjacent the interface 148 on the probe.

Figure 7B:
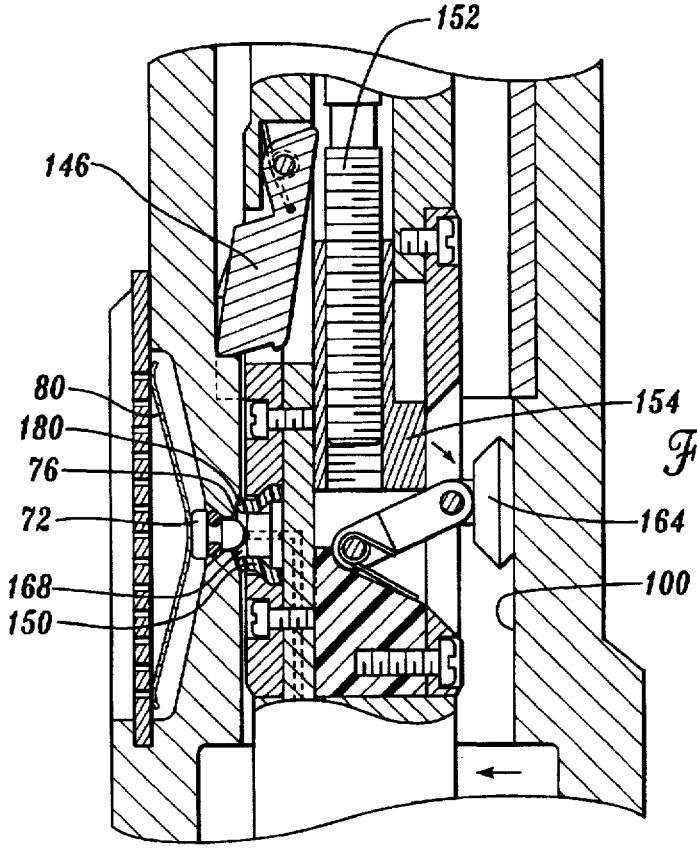

As shown in FIG. 7B, once the probe has been properly oriented within the casing assembly, the shoe 164 is extended from the probe body and brought into contact with the interior surface 100 of the measurement port coupler. As the shoe continues to extend from the probe body, the probe is pushed towards the measurement port. Simultaneously, the location arm 146 is allowed to swing inward as the probe nears the wall of the coupler. Prior to the measurement port being opened, the outer portion 180 of the face seal gasket 150 contacts the conical indentation 76 of the measurement port, completing a seal between the probe and the measurement port before the valve 72 to the exterior of the measurement port coupler is opened. At this point, a volume 168 bounded by the face seal gasket, the conical indentation, the valve, and the plunger is sealed from the exterior of the measurement port coupler and the interior of the measurement port coupler. Any fluid that is contained within the measurement port coupler is therefore prevented from entering the probe. Any fluid from outside of the measurement port coupler is also prevented from being released to the interior of the coupler, changing the pressure that may be measured in the zone outside the measurement port.

Figure 7C:
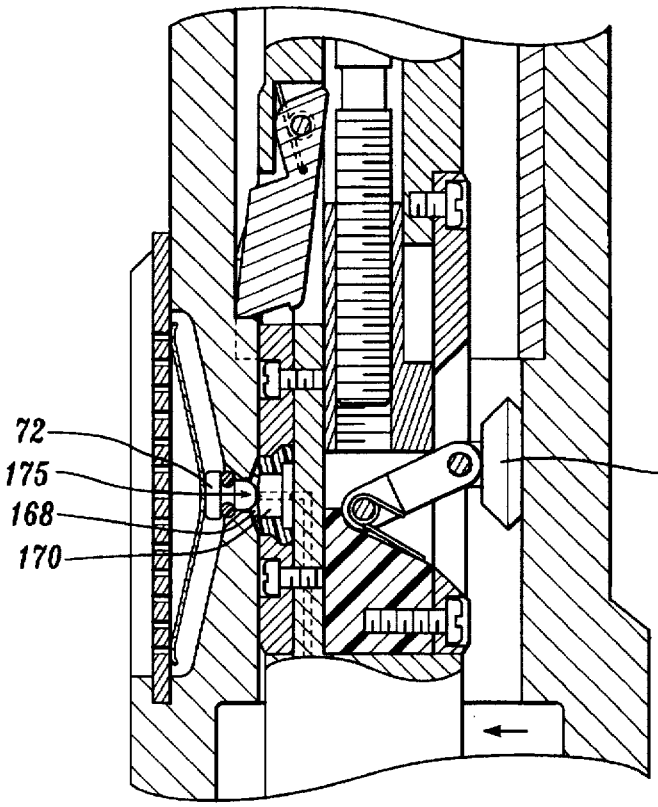

As shown in FIG. 7C, a continued extension of shoe 164 causes the plunger 170 to contact valve 72 and open the measurement port. As the plunger opens the measurement port, the sealed volume 168 bounded by the face seal gasket and the conical indentation 76 of the measurement port is reduced. To keep the measured pressure nearly constant, the face seal gasket expands radially to fill expansion voids 182 and 184 surrounding the gasket. The deformation of the face seal gasket helps to compensate for any pressure increase due to the compression of the probe into the measurement port. The compensation protects the often delicate pressure sensors 187 (or other instrumentation) from a spike of high pressure when the measurement port valve is being opened. Due to the compensation provided by the face seal gasket expanding into the expansion voids, the pressure remains relatively constant as the probe is biased against the measurement port.

When the plunger contacts and opens the port valve 72, fluid from outside the measurement port coupler is allowed to flow through the measurement port, through bore 175, and into the probe body where it may be sampled or its pressure measured. Only fluid from outside the measurement port coupler is sampled through the measurement port. The seal provided between the face seal gasket 150 and the conical indentation 76 prevents fluid from inside the measurement port coupler from contaminating the sampled material. Because the conical indentation is protected from scratching, pitting or other wear caused by movement of the probes within the measurement port coupler, the seal between the probe and the measurement port is reliably maintained for the life of the multi-level monitoring system.

When sampling or measurement is complete, the probe may be moved to a different measurement port coupler. To close the measurement port, the shoe 164 is slowly retracted into the probe body and the probe moves through an intermediate position as shown in FIG. 7B. Moving the probe away from the measurement port removes the pressure on valve 72, allowing the spring 80 to return the valve to a closed position. Closing the measurement port prevents fluid from outside of the coupler from flowing to the interior of the coupler. At the same time, the seal between the probe body and the measurement port is maintained by face seal gasket 150, preventing fluid from flowing into the interior of the measurement port coupler.

Figure 7D:
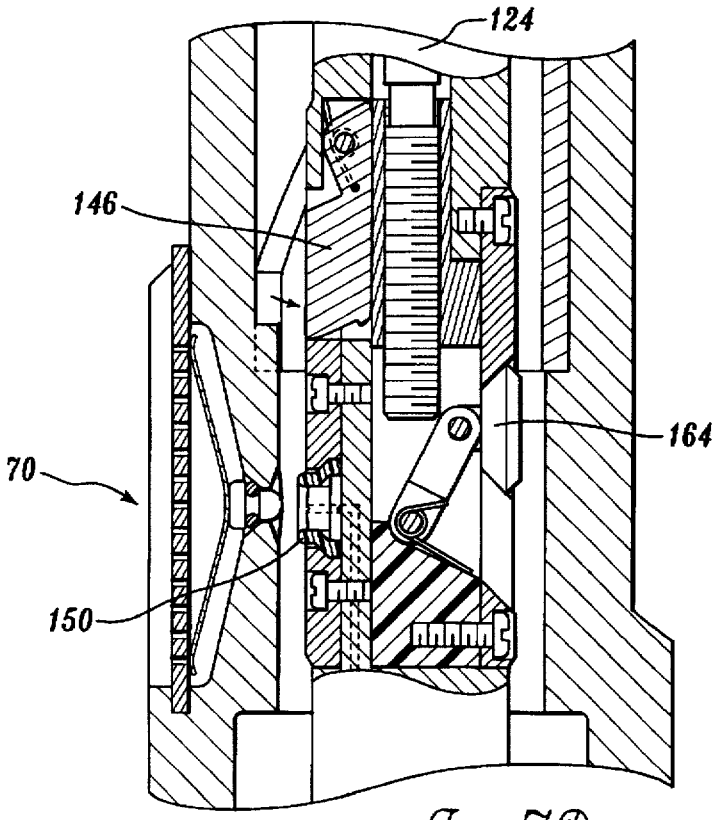

When the shoe 164 and actuator arm 146 are fully retracted, as shown in FIG. 7D, the face seal gasket 150 is removed from contact with the measurement port 70. The probe 124 may then be raised or lowered within the casing assembly to take samples at a different measurement port coupler. Because of the recessed measurement port valve, the movement of the probe within the casing assembly does not inadvertently cause the measurement port to open.

It will be appreciated that the above-described measurement port coupler offers several advantages over measurement port couplers used in the prior art. In particular, the accuracy of the measurement taken from the measurement port coupler is improved due to the improved measurement port and probe interface. The use of a conical depression to recess the measurement port valve below the interior surface of the measurement port coupler ensures that the valve is not inadvertently opened as the probe is raised and lowered within the casing assembly, and allows the geometry of the face seal to be simplified and significantly improved. The conical indentation is protected from scratching or other damage which would reduce the effectiveness of the seal that may be maintained between the probe and the measurement port. The use of expansion voids in the face seal gasket design also improves the accuracy of pressure measurements made through the measurement port. All of the above features are critical for proper operation of the multi-level monitoring system and significantly improve the overall performance and accuracy of measurements taken at the measurement port.

Further, the use of a removable screen and a removable helical insert improves the manufacturability of the measurement port coupler. Components may be replaced in the measurement port when found to be defective, and the entire assembly may be manufactured of plastic or other material which reduces any contamination that may be introduced into a borehole.

While the preferred embodiment of the invention has been illustrated and described, it will be appreciated that various changes can be made therein without departing from the spirit and scope of the invention. For example, the shape of the depression that is used to recess valve 72 from the interior surface of the measurement port coupler may be varied. Preferably, a conical depression is used to provide a smooth mating surface with the face seal gasket of the probe. It will be appreciated, however, that stepped, ellipsoid, parabolic, or other surfaces may be selected for the depression shape. The selected surface shape must merely be recessed from the inner surface of the measurement port coupler, and provide a sufficiently smooth mating surface to allow a pressure seal with face seal gasket 150.

Figure 8:
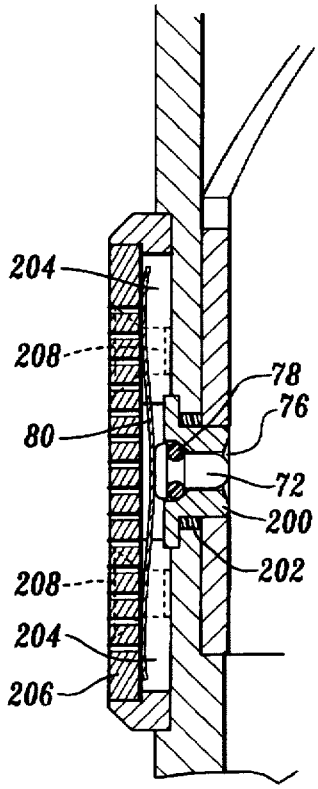
FIG. 8 is an alternate embodiment of a measurement port for incorporation in a metal measurement port coupler.

Those skilled in the art will also appreciate that the measurement port coupler may be formed of material other than PVC. In certain environments, it may be desirable to have the couplers or casing assembly constructed of steel or other metal. A cross section of a measurement port that may be incorporated in a steel coupler is disclosed in FIG. 8. The measurement port has the same components as the measurement port in a PVC coupler, namely valve 72, O-ring gasket 78, and spring 80. A slight modification is made to the coupler wall, however, to simplify the manufacture of the measurement port. In particular, an insert 200 is provided in an aperture that extends through the coupler wall. The insert is formed with a bore for seating the valve, and also with a conical depression 76 for ensuring that the stem of the valve is recessed below the interior surface of the coupler. Although O-ring gasket 78 is shown in FIG. 8 as being located around valve 72, the O-ring gasket may also be placed in the insert to surround the valve. Placement of the O-ring gasket in the insert offers some sealing advantage in high pressure environments.

An O-ring gasket 202 is provided around insert 200 to provide an air-tight seal between the insert and the wall of the coupler. The insert is fixed in the coupler wall by a set of spacers 204 that contact an outer flange of the insert on the external surface of the casing. Spacers are held in place by a perforated cover plate 206 that is affixed to the coupler by a set of screws 208. As before, the cover plate is removable to allow access to the measurement port for maintenance. It will be appreciated that an advantage of forming the insert 200 separately from the coupler is that the insert may be made of a material that is more wear resistant than the coupler. Materials may therefore be selected for each component of the measurement port coupler in order to maximize the longevity of the measurement port.

It will also be appreciated that the improved measurement port disclosed herein may be also be used in other couplers or casings in the casing assembly. For example, the measurement port may be incorporated in casings having packer elements to allow the inflation of the packer elements. Consequently, within the scope of the appended claims, it will be appreciated that the invention can be practiced other than as specifically described herein.

The embodiments of the invention in which an exclusive property or privilege is claimed are defined as follows:

What is claimed is:

1. A casing incorporating a measurement port for use in a multilevel borehole monitoring system, the measurement port allowing fluid from the exterior of the casing to enter the interior of the casing when the measurement port is opened by a sampling probe within the casing, and preventing fluid from entering the interior of the casing when the measurement port is closed, the casing comprising:

(a) a tubular wall having opposite open ends that are couplable to adjacent casings, an external surface, an interior surface, and being formed with an aperture extending through the wall;

(b) a valve seated in the aperture, the valve having a stem facing the interior of the casing and being recessed in the aperture so that the stem does not extend beyond the interior surface of the casing into the interior of the casing;

(c) sealing means fitted around the valve to provide a seal between the valve and the aperture; and (d) means to bias the valve in a normally closed position so that fluid cannot enter the casing until the valve is moved to an open position by the sampling probe.

2. The measurement port of claim 1, wherein the aperture comprises a bore portion for seating the valve and a mating portion for mating with the sampling probe.

3. The measurement port of claim 2, wherein the mating portion is conical and tapers outwardly from the bore portion to the interior surface of the casing wall.

4. The measurement port of claim 1, wherein the means to bias the valve in a normally closed position is a spring.

5. The measurement port of claim 4, wherein the spring is a flat spring.

6. The measurement port of claim 1, further comprising a cover plate attached to the exterior surface of the casing in a position over the measurement port, the cover plate formed with a plurality of holes to filter fluids flowing through the measurement port.

7. The measurement port of claim 6, wherein the cover plate is removable.

8. A casing incorporating a measurement port for use in a multilevel borehole monitoring system, the measurement port allowing fluid from the exterior of the casing to enter the interior of the casing when the measurement port is opened by a sampling probe within the casing, and preventing fluid from entering the interior of the casing when the measurement port is closed, the casing comprising:

(a) a tubular wall having opposite open ends that are couplable to adjacent casings, an external surface, an interior surface, and being formed with an aperture extending through the wall;

(b) a valve seated in the aperture;

(c) sealing means fitted around the valve to provide a seal between the valve and the aperture;

(d) means to bias the valve in a normally closed position so that fluid cannot enter the casing until the valve is moved to an open position by the sampling probe; and (e) a cover plate removably attached to the exterior surface of the casing in a position over the aperture, the cover plate formed with a plurality of holes to filter fluids flowing through the aperture when the valve is moved to the open position.

9. The casing of claim 8, further comprising a pair of retaining arms attached to the exterior surface of the tubular wall of the casing, each of the pair of retaining arms formed with a slot sized to receive a lateral edge of the cover plate in order to fix the cover plate over the aperture in the casing.

10. The casing of claim 8, wherein the cover plate is formed with a plurality of screw holes.

11. The casing of claim 10, further comprising a plurality of retaining screws, each of the retaining screws extending through one of the plurality of screw holes and into the tubular wall to secure the cover plate to the exterior surface of the casing.

12. The casing of claim 8, wherein the cover plate is a metal sheet formed with a plurality of slots.

13. The casing of claim 8, wherein the cover plate is a wire mesh.

14. A casing incorporating a measurement port for use in a multilevel borehole monitoring system, the measurement port allowing fluid from the exterior of the casing to enter the interior of the casing when the measurement port is opened by a sampling probe within the casing, and preventing fluid from entering the interior of the casing when the measurement port is closed, the casing comprising:

(a) a tubular body having opposite open ends that are couplable to adjacent casings, an external surface, an interior surface, and being formed with an aperture extending from the exterior of the body to the interior of the body, the interior surface forming a passageway extending between the opposite open ends of the body;

(b) a valve seated in the aperture;

(c) sealing means fitted around the valve to provide a seal between the valve and the aperture;

(d) means to bias the valve in a normally closed position so that fluid cannot enter the casing until the valve is moved to an open position by the sampling probe; and (e) a helical insert removably fitted within the passageway of the tubular body, the helical insert having a helical shoulder curving around the longitudinal axis of the tubular body and extending from an outer end located proximate to the open end of the tubular body to an inner end remote from the open end, the helical shoulder being engageable by a stop arm radiating from the sampling probe as the sampling probe moves along the passageway in the tubular body to guide the stop arm and rotate the sampling probe so that the sampling probe is turned to a desired orientation adjacent the valve.

15. The casing of claim 14, wherein the passageway in the tubular body has an initial diameter extending a portion of the passageway and a final diameter extending the remainder of the passageway, wherein the initial diameter is greater than the final diameter so that at a point where the passageway narrows from the initial diameter to the final diameter a stop is formed extending around the circumference of the passageway.

16. The casing of claim 15, wherein the helical insert is fitted within the portion of the passageway having an initial diameter, the helical insert abutting the stop to locate the helical insert at a desired longitudinal position within the tubular body.

17. The casing of claim 16, wherein the tubular body further comprises a locating tab extending from the stop in the portion of the passageway having an initial diameter, the helical insert formed with a corresponding slot sized to receive the locating tab to orient the helical insert at a desired circumferential position within the tubular body.

18. The casing of claim 14, wherein the helical insert is formed of a first material and the tubular body of the casing is formed of a second material.

19. The casing of claim 18, wherein the first material is a metal and the second material is a plastic.

20. A casing incorporating a measurement port for use in a multilevel borehole monitoring system, the measurement port allowing fluid from the exterior of the casing to enter the interior of the casing when the measurement port is opened by a sampling probe within the casing, and preventing fluid from entering the interior of the casing when the measurement port is closed, the casing comprising:

(a) a tubular body having opposite open ends that are couplable to adjacent casings, an external surface, an interior surface, and being formed with an aperture extending from the exterior of the body to the interior of the body, the interior surface forming a passageway extending between the opposite open ends of the body;

(b) a valve seated in the aperture;

(c) sealing means fitted around the valve to provide a seal between the valve and the aperture;

(d) means to bias the valve in a normally dosed position so that fluid cannot enter the casing until the valve is moved to an open position by the sampling probe; and (e) a helical insert removably fitted within the passageway of the tubular body, the helical insert having a pair of helical shoulders curving away from each other around the longitudinal axis of the tubular body and extending from adjacent outer ends located proximate to the open end of the tube to adjacent inner ends remote from the open end, the helical insert being engageable by a stop arm radiating from the sampling probe as the sampling probe moves along the passageway in the tubular body to guide the stop arm and rotate the sampling probe so that the sampling probe is turned to a desired orientation adjacent the valve.

21. The casing of claim 20, wherein the passageway in the tubular body has an initial diameter extending a portion of the passageway and a final diameter extending the remainder of the passageway, wherein the initial diameter is greater than the final diameter so that at a point where the passageway narrows from the initial diameter to the final diameter a stop is formed extending around the circumference of the passageway.

22. The casing of claim 21, wherein the helical insert is fitted within the portion of the passageway having an initial diameter, the helical insert abutting the stop to locate the helical insert at a desired longitudinal position within the tubular body.

23. The casing of claim 22, wherein the tubular body further comprises a locating tab extending from the stop in the portion of the passageway having an initial diameter, the helical insert formed with a corresponding slot sized to receive the locating tab to orient the helical insert at a desired circumferential position within the tubular body.

24. The casing of claim 23, wherein the slot is located between the adjacent inner ends of the helical insert.

25. The casing of claim 24, wherein the helical insert is formed with an outer diameter that is slightly greater than the initial diameter of the passageway, the inner ends of the helical insert being compressible towards each other to allow the helical insert to be inserted into the tubular body and held in place by a tendency of the inner ends of the helical insert to return to an uncompressed state.

26. The casing of claim 20, wherein the helical insert is formed of a first material and the tubular body of the casing is formed of a second material.

27. The casing of claim 26, wherein the first material is metal and the second material is plastic.

28. A multilevel borehole monitoring system to allow the sampling of fluid from a borehole at various levels within the borehole, the borehole monitoring system comprising:

(a) a plurality of casings coupled together to form a casing assembly within the borehole, the plurality of casings forming a passageway extending the length of the casing assembly, at least one of the plurality of casings being a measurement port coupler comprising:

(i) a tubular wall having an external surface, an interior surface, and being formed with an aperture extending through the wall, the aperture having a bore portion and a mating portion;

(ii) a valve seated in the bore portion of the aperture, the valve having a stem facing the interior of the casing and being recessed in the aperture so that the stem does not extend beyond the interior surface into the passageway of the casing;

(iii) sealing means fitted around the valve to provide a seal between the valve and the aperture; and (iv) means to bias the valve in a normally closed position so that fluid cannot enter the measurement port coupler until the valve is moved to an open position; and (b) a sampling probe that may be raised and lowered in the borehole within the passageway formed by the plurality of casings, the sampling probe comprising:

(i) a body having a sampling aperture that extends from the exterior of the body to the interior of the body;

(ii) a gasket attached to the body of the sampling probe and surrounding the sampling aperture;

(iii) means to locate the sampling probe adjacent a desired measurement port coupler in the plurality of casings;

(iv) means to bias the sampling probe against the interior surface of the measurement port coupler, the gasket contacting the mating portion of the aperture and forming a seal between the measurement port coupler and the sampling probe before the valve on the measurement port coupler is moved to the open position; and (v) means to move the valve to the open position and allow the sampling probe to sample fluid in the borehole outside of the measurement port coupler, the fluid flowing through the aperture of the measurement port coupler and the sampling aperture of the sampling probe.

29. The borehole monitoring system of claim 28, wherein the mating portion is conical and tapers outwardly from the bore portion to the interior surface of the tubular wall.

30. The borehole monitoring system of claim 29, wherein an outer surface of the gasket is coplaner with the mating portion of the aperture.

31. The borehole monitoring system of claim 28, wherein the means to move the valve to the open position comprises a plunger extending through the sampling aperture, the plunger contacting the stem of the valve as the sampling probe is biased against the interior surface of the measurement port coupler and causing the valve on the measurement port coupler to move to the open position.

32. The borehole monitoring system of claim 28, wherein the body of the sampling probe is further formed with expansion voids surrounding the gasket, the expansion voids allowing the gasket to expand as the sampling probe is biased against the interior surface of the measurement port coupler and compensate for any pressure increase in a volume bounded by the gasket, the mating portion of the aperture, the valve, and the means to move the valve to the open position.

* * * * *

UNITED STATES PATENT AND TRADEMARK OFFICE

CERTIFICATE OF CORRECTION

PATENT NO. : 5,704,425

DATED : January 6, 1998

INVENTOR(S) : J.J. Divis et al.

It is certified that error appears in the above-identified patent and that said Letters Patent is hereby corrected as shown below:

| COLUMN | LINE | |
|---|---|---|
| 15 (Claim 20, | 22 line 17) | "dosed" should read --closed-- |

Signed and Sealed this

Twenty-third Day of June, 1998

Bruce Lehman

*Attest:*

BRUCE LEHMAN

*Attesting Officer*

*Commissioner of Patents and Trademarks*